US009109437B2

(12) United States Patent
Rogers et al.

(10) Patent No.: US 9,109,437 B2
(45) Date of Patent: Aug. 18, 2015

(54) METHOD OF USING AN EXPANSION TOOL FOR NON-CEMENTED CASING ANNULUS (CCA) WELLBORES

(75) Inventors: Henry Eugene Rogers, Duncan, OK (US); David D. Szarka, Duncan, OK (US); Derrick Eugene Strickland, Yukon, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 610 days.

(21) Appl. No.: 13/435,672

(22) Filed: Mar. 30, 2012

(65) Prior Publication Data

US 2013/0255967 A1 Oct. 3, 2013

(51) Int. Cl.

| | |
|---|---|
| ***E21B 29/10*** | (2006.01) |
| ***E21B 43/10*** | (2006.01) |
| ***E21B 17/10*** | (2006.01) |

(52) U.S. Cl.

CPC ..... *E21B 43/105* (2013.01); *E21B 17/1078* (2013.01); *E21B 29/10* (2013.01)

(58) Field of Classification Search

CPC ... E21B 43/103; E21B 43/105; E21B 43/108; E21B 29/10

USPC ..... 166/277, 384, 207, 209, 212, 216; 72/393, 370.08, 452.7; 425/467

See application file for complete search history.

(56) References Cited

U.S. PATENT DOCUMENTS

| | | | | |
|---|---|---|---|---|
| 2,447,629 | A * | 8/1948 | Beissinger et al. | 166/207 |
| 4,220,034 | A * | 9/1980 | Pogonowski | 72/399 |
| 4,309,891 | A * | 1/1982 | Pogonowski | 72/399 |
| 7,090,025 | B2 | 8/2006 | Haugen et al. | |
| 2004/0079528 | A1* | 4/2004 | Metcalfe et al. | 166/297 |
| 2007/0256827 | A1* | 11/2007 | Guerrero et al. | 166/207 |
| 2008/0115939 | A1* | 5/2008 | Cook et al. | 166/297 |
| 2009/0242213 | A1 | 10/2009 | Braddick | |

(Continued)

FOREIGN PATENT DOCUMENTS

| | | |
|---|---|---|
| EP | 1306519 A2 | 5/2003 |
| WO | 2010072751 A2 | 7/2010 |

(Continued)

OTHER PUBLICATIONS

International Search Report and Written Opinion for PCT/US2013/029829 dated Jul. 4, 2014.

(Continued)

*Primary Examiner* — Jennifer H Gay
*Assistant Examiner* — David Carroll
(74) *Attorney, Agent, or Firm* — McDermott Will & Emery LLP; John W. Wustenberg

(57) ABSTRACT

A method for centralizing an inner casing within an outer casing includes introducing an expansion tool into the inner casing, the expansion tool having an elongate body having a first force multiplier case coupled to an expansion tool case. A piston is arranged within the first force multiplier case and is actuated to move the piston axially in a first direction. A ram is arranged within the expansion tool case and engaged with the piston while moving in the first direction. One or more lug assemblies are arranged within the expansion tool case and are radially expanded with the ram as the ram axially translates in the first direction. The inner casing is plastically deformed with the one or more lug assemblies, which generate a corresponding one or more lugs in the inner casing configured to engage an inner surface of the outer casing.

14 Claims, 6 Drawing Sheets

(56) References Cited

U.S. PATENT DOCUMENTS

| | | | | |
|---|---|---|---|---|
| 2010/0243266 | A1* | 9/2010 | Soby et al. | 166/373 |
| 2010/0307736 | A1* | 12/2010 | Hearn et al. | 166/117.5 |
| 2013/0255935 | A1 | 10/2013 | Rogers et al. | |

FOREIGN PATENT DOCUMENTS

| | | | | |
|---|---|---|---|---|
| WO | WO 2010072751 | A2 * | 7/2010 | E21B 43/10 |
| WO | 2013148110 | A2 | 10/2013 | |
| WO | 2013148115 | A2 | 10/2013 | |

OTHER PUBLICATIONS

International Search Report and Written Opinion for PCT/US2013/029765 dated May 9, 2014.

* cited by examiner

METHOD OF USING AN EXPANSION TOOL FOR NON-CEMENTED CASING ANNULUS (CCA) WELLBORES

BACKGROUND

The present invention relates to centralization tools, and more particularly, to the use of expansion tools comprising an expander and an actuator configured to centralize a casing-casing annulus in a wellbore.

The development of directional drilling technologies allows for strongly deviated boreholes. The use of horizontal or otherwise deviated drilling provides several advantages including making it possible to reach reservoirs miles away from the wellhead. This is especially useful if the reservoir is located in an area where vertical drilling is not possible or is undesirable such as under a lake or an environmentally sensitive area. In practice, true vertical wellbores are difficult, if not impossible, to achieve. In other words, vertical wellbores typically have at least some intervals or sections that are deviated.

In some cases, directional drilling may be used to drill a new wellbore originating from an existing wellbore. For example, one may insert a kick-off device, such as a whipstock assembly, vertically down to a kick-off point and then initiate directional drilling within the existing wellbore. Directional drilling is often desirable because it increases the exposed section length through the reservoir and allows more wellheads to be grouped together at one location at less cost, which should result in fewer rig moves, and less surface area disturbance.

Over the past several decades, drilling operations have left many wells depleted or economically unviable. Some of these wells have been left uncemented but still contain nested casing strings having an inner casing or tubular arranged within an outer casing or tubular. For example, FIG. 1A shows a cross-sectional top view of an inner casing 14 longitudinally arranged within an outer casing 16, and FIG. 1B depicts a cross-sectional side view of the inner casing 14 as arranged within the outer casing 16. An annulus 15, oftentimes being referred to as the casing-casing annulus (CCA), is generally defined between the inner and outer casings 14, 16. When the inner casing 14 is not properly centralized or cemented within the outer casing 16, the inner casing 14 is effectively free to move radially within the outer casing 16. Because true vertical wells rarely exist in practice, over time, the inner casing 14 may tend to lean towards the outer casing 16 at certain points due to factors such as gravity, thereby resulting in a non-concentric annulus 15.

As depicted in both FIGS. 1A and 1B, the inner casing 14 has come into contact with the outer casing 16. As a result, at least a portion of the annulus 15 exhibits zero clearance or stand-off distance between the outer radial surface of the inner casing 14 and the inner radial surface of the outer casing 16. As used herein, "clearance" or "stand-off distance" refers to the minimal distance between casings in a casing-casing annulus. For the purposes of this disclosure, the terms "clearance" and "stand-off distance" may be used interchangeably. Non-concentric annuli may lead to gas channeling problems during subsequent intervention operations (e.g., kickoff, lateral, etc.). Moreover, an annulus 15 exhibiting poor clearance or stand-off will also suffer from poor displacement efficiency of fluids.

One way to maximize the clearance of a casing-casing annulus is to use centralizers configured to center the inner casing 14 relative to the outer casing 16. Typical centralizers include bow springs and solid centralizers. The use of bow springs, however, is often limited to vertical and low angle wells since they have high associated running forces and may collapse under casing weight in higher angles. Solid centralizers were introduced largely because of the shortcomings of bow springs. Unfortunately, however, the use of solid centralizers is often time consuming, expensive, and waste apparent.

SUMMARY OF THE INVENTION

The present invention relates to centralization tools, and more particularly, to the use of expansion tools comprising an expander and an actuator configured to centralize a casing-casing annulus in a wellbore.

In some embodiments, the present invention provides methods for centralizing an inner casing within an outer casing, comprising: introducing an expansion tool into the inner casing, the expansion tool having an elongate body having a first force multiplier case coupled to an expansion tool case; actuating a piston arranged within the first force multiplier case and thereby moving the piston axially in a first direction within the first force multiplier case; engaging a ram arranged within the expansion tool case with the piston; radially expanding one or more lug assemblies arranged within the expansion tool case with the ram as the ram axially translates in the first direction; and plastically deforming the inner casing with the one or more lug assemblies, the one or more lug assemblies generating a corresponding one or more lobes in the inner casing configured to engage an inner surface of the outer casing.

In other embodiments, the present invention provides methods for centralizing an inner casing within an outer casing, comprising: introducing an expansion tool into the inner casing, the expansion tool having an elongate body configured to be coupled to a work string and run into a wellbore; actuating a piston arranged within the elongate body and thereby moving the piston axially in a first direction within the elongate body; engaging a ram arranged within the elongate body with the piston and thereby forcing the ram to axially translate in the first direction, the ram defining a tapered surface in contact with one or more lug assemblies arranged within a corresponding one or more cavities defined in the elongate body; radially-expanding the one or more lug assemblies with the ram as the ram axially translates in the first direction; and plastically deforming the inner casing with the one or more lug assemblies, the one or more lug assemblies generating a corresponding one or more lobes in the inner casing configured to engage an inner surface of the outer casing.

In still other embodiments, the present invention provides methods comprising: running an expansion tool into an inner casing arranged within an outer casing, the inner and outer casings being arranged within a wellbore and defining an annulus therebetween having a first stand-off percentage; centering the inner casing relative to the outer casing with the expansion tool, thereby increasing a clearance of the annulus to a second stand-off percentage; perforating the inner casing to fluidly communicate the inner casing with annulus; introducing a settable fluid into the annulus via the inner casing; and defining a window through the inner casing, the settable fluid, and the outer casing in order to initiate a lateral wellbore.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

Figure 1A:
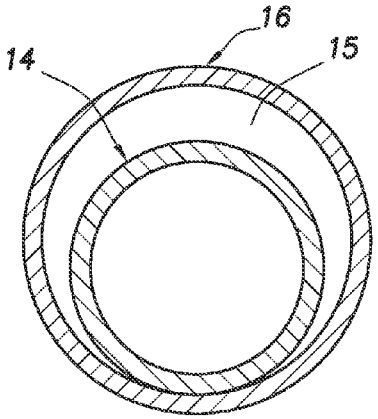
FIGS. 1A-1B show various schematic views of a typical non-centralized casing-casing annulus.

The present invention relates to centralization tools, and more particularly, to the use of expansion tools comprising an expander and an actuator configured to centralize a casing-casing annulus in a wellbore. To facilitate a better understanding of the present invention, the following examples and embodiments are given. In no way should the following examples be read to limit, or to define, the scope of the invention. For clarity and convenience, the features of the present invention have been consistently labeled in all the Figures described herein.

The present invention provides embodiments of an expansion tool and methods of using the same for the centralization of nested casings. As briefly described above, many depleted or economically unviable wells have portions or sections of the nested casings that are not cemented or otherwise centralized with respect to one another. The exemplary expansion tool disclosed herein provides the opportunity to re-work these existing wells that are past their productive life by enabling kick-off drilling operations to be performed without the need to cut, pull, transport, and dispose of the existing casing strings already in the wellbore. This may be particularly important when it is difficult or very costly to remove such casings. While embodiments disclosed herein may be used to initiate the drilling of a new wellbore from an existing wellbore, embodiments are also contemplated herein which serve to stabilize a wellbore, among other advantages.

In order to start directional drilling from an existing wellbore, the nested casings typically require centralization and competent isolation so that one or more windows may be cut through the inner and outer casings in order to facilitate drilling of a new wellbore. Embodiments disclosed herein are not only useful in centralizing nested casings, however, but also allow for the competent isolation (e.g., pressure isolation) of the annulus defined between the nested casings. Effectively isolating the nested casings allows the annulus defined therebetween to accept and withstand additional formation pressures that may arise from the new wellbore.

Another advantage of the embodiments disclosed herein is the resulting centralization of the nested casings which, in turn, allows for a greater displacement efficiency during subsequent cementing operations. As used herein, "displacement efficiency" generally refers to the efficiency of replacing mud with cement. Those skilled in the art will readily recognize that higher displacement efficiency is generally desirable during a cementing operation. The embodiments disclosed herein achieve high levels of stand-off between the nested casings which in turn leads to greater displacement efficiencies.

The expansion tools of the present invention are generally made of high-strength materials (e.g., metals, alloys, etc.) and allow the user to target specific well depths where maximum displacement efficiency is desired in order to achieve the best chance of performing a competent cementing job in an initially non-cemented casing-casing annulus.

Figure 2:
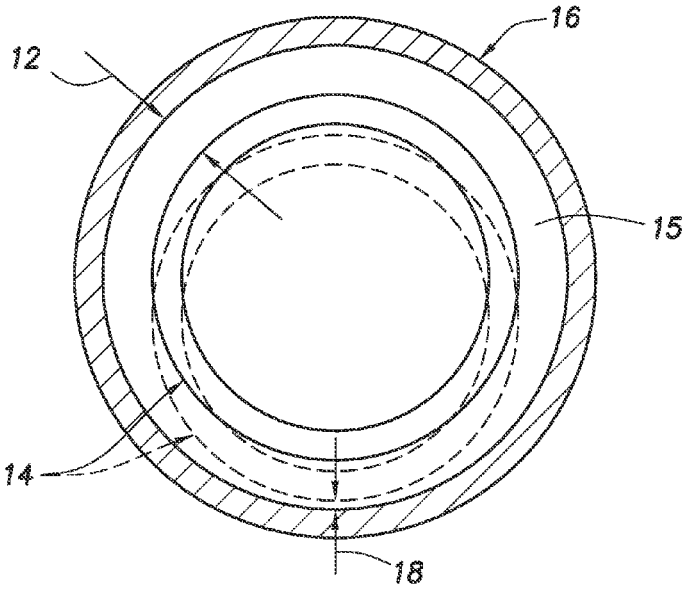
FIG. 2 shows a schematic drawing of casing-casing annulus depicting a non-concentric and a concentric inner casing.

Referring to FIG. 2, illustrated is a cross-sectional end view of the inner casing 14 as arranged within the outer casing 16, according to one or more embodiments of the present disclosure. An annulus 15 (i.e., the casing-casing annulus) is generally defined between the inner and outer casings 14, 16. In one or more embodiments, the degree of centralization of the inner casing 14 within the outer casing 16 may be characterized or otherwise specified as a stand-off percentage. The stand-off percentage may be calculated by taking the ratio of an actual clearance distance 18 (i.e., actual stand-off distance) to a concentric clearance distance 12 (i.e., concentric stand-off distance), where the concentric clearance distance 12 is a measure of a perfectly centered inner casing 14 within the outer casing 16. Calculating the stand-off percentage may be done as shown below in equation (1):

$$\text{Stand-off }\% = (\text{Actual Clearance})/(\text{Concentric Clearance}) \times 100\% \quad (1)$$

where the actual clearance distance 18 is the minimum distance between the inner and outer casings 14, 16, and the concentric clearance distance 12 is the maximum distance between the inner and outer casings 14, 16, or in other words where the inner casing 14 is concentrically-disposed within the outer casing 16.

Figure 1B:
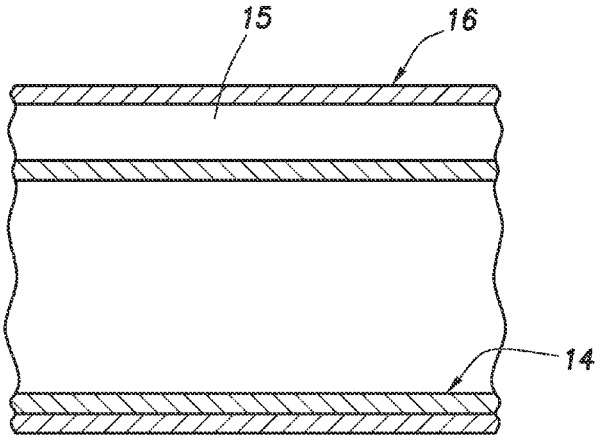

A stand-off percentage of 100% indicates that the inner casing 14 is perfectly centered relative the outer casing 16. In other words, the inner casing 14 is concentrically-disposed within the outer casing 16. In contrast, a stand-off percentage of 0% indicates that the inner casing 14 is in contact with the outer casing 16, such as shown in FIGS. 1A-1B. The exemplary expansion tools disclosed herein may be configured to centralize the inner casing 14 within the outer casing 16, thereby generating a concentrically-disposed or generally concentrically-disposed annulus 15. Embodiments disclosed herein may be configured to centralize an inner casing 14 having an initial stand-off distance ranging anywhere from about 0% to about 99%.

Generally, the terms "centralization", "centralize", or "center" do not necessarily imply any particular degree of centralization or centering. In other words, these terms do not necessarily indicate that a stand-off percentage of 100% has been achieved. Rather, these terms are generally used to indicate that a relative increase in the stand-off percentage has been attained. For example, the inner casing 14 may have an initial stand-off percentage prior to centralization and a final stand-off percentage after centralization. In some embodiments, the terms "centralization", "centralize", and "center" and their related terms can suggest that the final stand-off percentage of the inner casing 14 is greater than the initial stand-off percentage or that the final stand-off percentage is at or about 100%.

Figure 3:
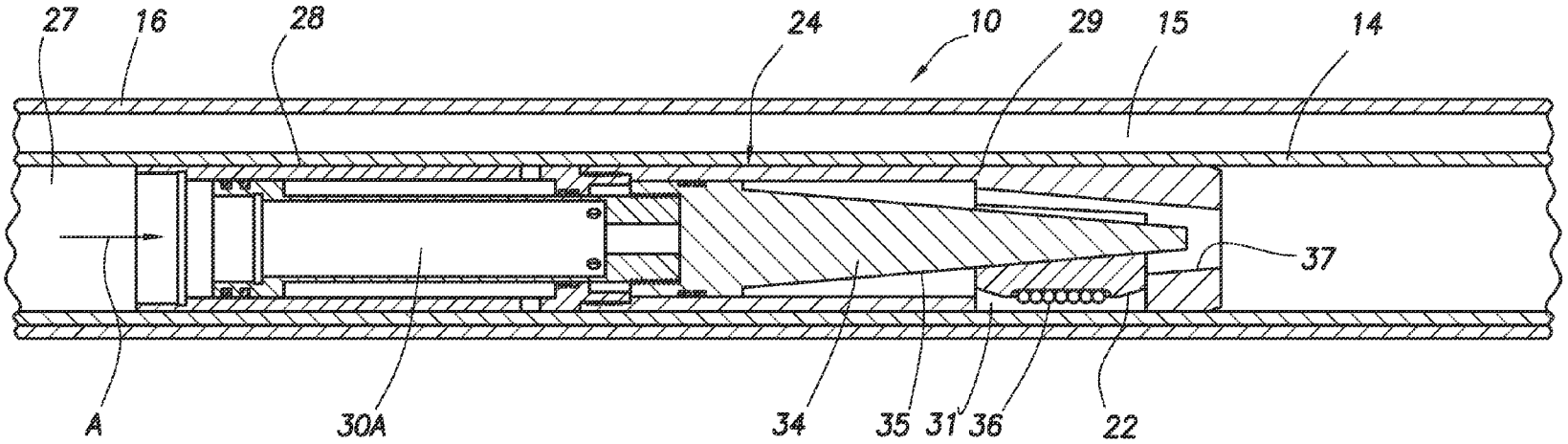
FIG. 3 shows a schematic drawing of a hydraulic expansion tool, in accordance with certain aspects of the present disclosure.

Referring now to FIG. 3, illustrated is an exemplary expansion tool 10, according to one or more embodiments disclosed. In some embodiments, the expansion tool 10 may be characterized as a single-force multiplier expansion tool. As illustrated, the expansion tool 10 may be arranged within an inner casing 14 which, in turn, is arranged within an outer casing 16 and an annulus 15 is defined therebetween. In one or more embodiments, the expansion tool 10 may be characterized as a hydraulically-actuated device. However, as described in greater detail below, other actuator means may also be appropriately employed, without departing from the scope of the disclosure.

The expansion tool 10 may include an elongate body 24 having a force multiplier case 28 coupled or otherwise attached to an expansion tool case 29. The body 24 may be configured to be coupled or otherwise attached to drill pipe, tubing, or any other type of work string 27 that extends from the surface and is able to run the expansion tool 10 into the wellbore. A piston 30A may be substantially arranged within the force multiplier case 28. The piston 30A may be configured to translate axially within the case 28 in response to a force applied thereto in an axial direction A. In other words, the piston 30A may be actuated by the input of an independent force or stimulus, such as through hydraulic pressure applied through the work string 27. In other embodiments, however, the piston 30A may be a hydraulic actuator such that the piston 30A is able to be actuated independently in order to move in the axial direction A. In yet other embodiments, the piston 30A may be an electric actuator, mechanical actuator, pneumatic actuator, combinations thereof, or the like, such that the piston 30A is actuated in order to move in the axial direction A.

The piston 30A may be coupled to or otherwise axially bias a ram 34 arranged within the expansion tool case 29. The ram 34 may be configured to axially translate within the expansion tool case 29 in response to a corresponding force applied to the ram 34 by the piston 30A. In at least one embodiment, the piston 30A and the ram 34 may form a monolithic, one-piece structure. In other embodiments, however, the piston 30A and ram 34 are integral components of an assembly and coupled together for mutual movement. The ram 34 may define a tapered surface 35 that extends along at least a portion of the axial length of the ram 34. The tapered surface 35 may be configured to mate with a corresponding tapered surface 37 defined on the expansion tool case 29. In operation, as the ram 34 translates in the direction A, the corresponding tapered surfaces 35, 37 become engaged and the tapered surface 37 of the expansion tool case 29 serves to maintain the ram 34 concentrically-disposed within the expansion tool case 29.

The expansion tool 10 may further include one or more lug assemblies 22 (one shown in FIG. 3) arranged within the expansion tool case 29. Each lug assembly 22 may include one or more lug components 36 radially disposed thereon or otherwise associated therewith. In at least one embodiment, each lug assembly 22 may be arranged within a corresponding cavity 31 defined in the tapered surface 37 of the expansion tool case 29. The cavity 31 may be configured to maintain the corresponding lug assembly 22 in its axial position as the ram 34 translates in the direction A.

As illustrated, the lug components 36 may be arranged on an outer surface of the lug assembly 22. In some embodiments, the lug components 36 may be attached to the lug assembly 22. In other embodiments, however, the lug components 36 may be monolithically or integrally fabricated as part of the lug assembly 22. The lug components 36 may be of any hard material including metals, alloys (e.g., steel), composite materials and the like. In one embodiment, for example, the lug components 36 may be made from a material that is stronger than the material of the inner casing 14. The lug components 36 may be of any shape including, but are not limited to, spherical, cylindrical, rectangular, and the like.

Figure 4:
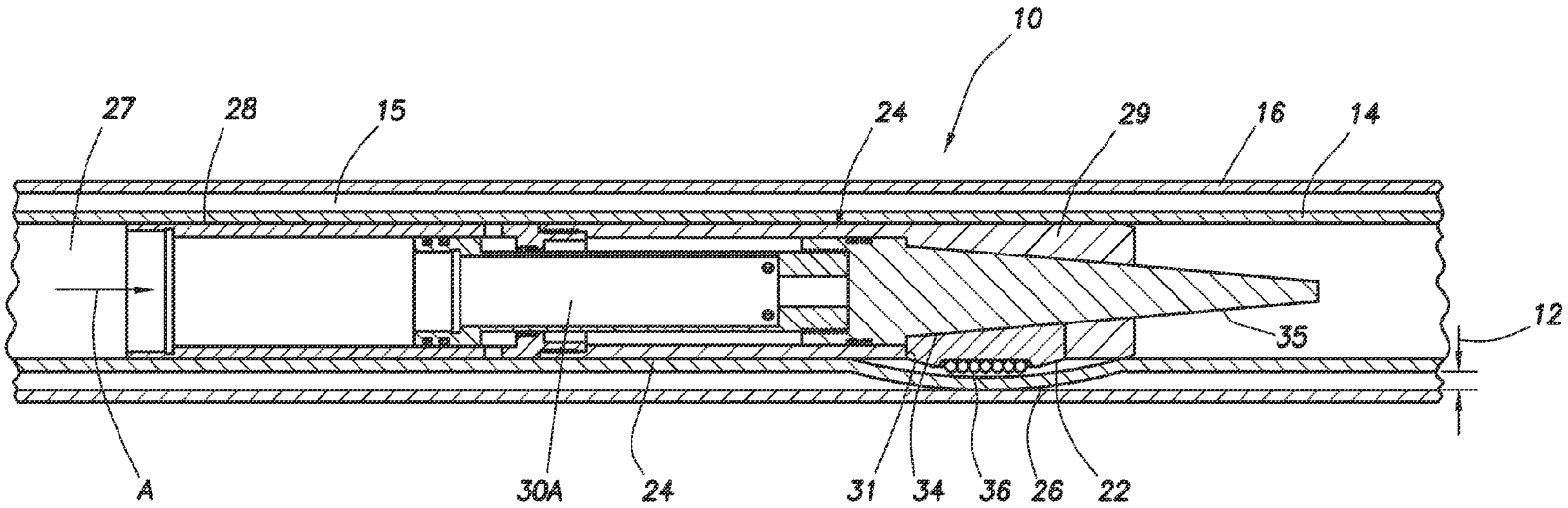
FIG. 4 shows a schematic drawing of the hydraulic expansion tool, in accordance with certain aspects of the present disclosure.

Referring now to FIG. 4, illustrated is the exemplary expansion tool 10 after being translated a distance in the direction A, according to one or more embodiments. The ram 34 in FIG. 4 is shown at "full travel" which corresponds to the expansion mode of the expansion tool 10. In operation, a downward longitudinal force may be applied to the piston 30A which, in turn, transfers that longitudinal force to the ram 34. In one embodiment, the downward longitudinal force may be hydraulic pressure provided via the work string 27 and acting on the piston 30A. As the ram 34 axially translates in the direction A, the lug assemblies 22 ride on or otherwise engage the tapered surface 35 of the ram 34 and are thus forced radially outward within the corresponding cavity 31. Forcing the lug assemblies 22 radially outward serves to simultaneously force the lug components 36 radially outward and into biasing engagement with the inner radial surface of the inner casing 14. Increasing the downward longitudinal force on the tapered ram 34 causes the lug components 36 to plastically deform the inner casing 14 and form one or more lobes 26 in the inner casing 14.

Figure 7A:
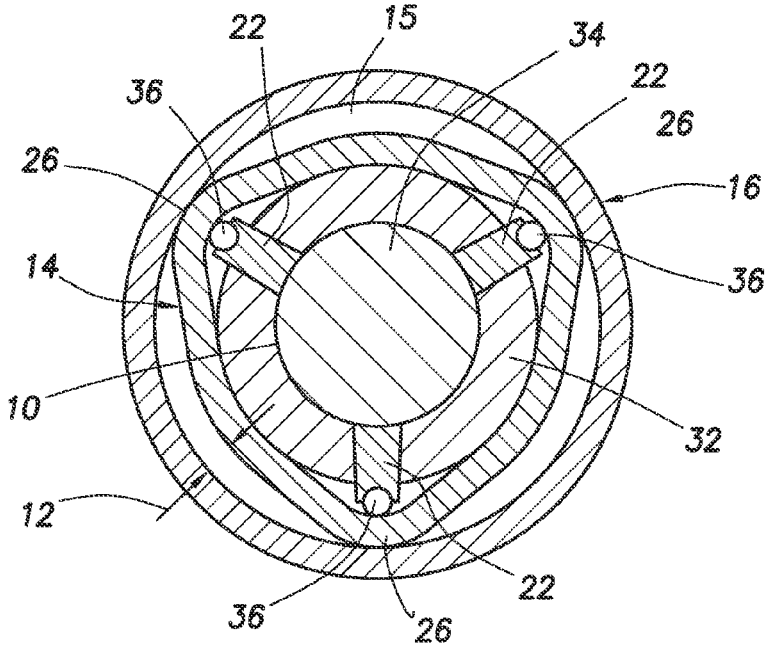
FIGS. 7A-7B show top views of a casing-casing annulus, in accordance with certain aspects of the present disclosure.

Referring briefly to FIG. 7A, the exemplary expansion tool 10 is illustrated as forming a total of three lobes 26 in the inner casing 14, corresponding to a total of three lug assemblies 22. As can be appreciated, this deformation results in an improved stand-off (up to a concentric stand-off 12) of the inner casing 14 with respect to the outer casing 16. While three lug assemblies 22 are specifically illustrated, it will be appreciated that any number of lug assemblies 22 may be employed without departing from the scope of the disclosure. In one or more embodiments, the lug assemblies 22 may be circumferentially spaced apart from each other by about 120°, as shown in FIG. 7A, but may equally be configured to be spaced closer or farther apart from each other, depending on the application. As will be appreciated, the exact circumferential spacing of the respective lobes 26 will depend on the number of lug assemblies 22.

It should be noted that the embodiments disclosed herein are not limited to any particular number and/or configuration of lug assemblies 22. The exact number and/or configuration of lug assemblies 22 used will depend on a number of factors such as difficulty of fabrication, cost, effectiveness, and the like. The evaluation of such factors will be apparent to those of ordinary skill in the art. Moreover, those skilled in the art will readily recognize that the exemplary expansion tools disclosed herein may be able to centralize nested casings having varying diameters. For example, the expansion tool 10 may be configured to center a 7 inch diameter inner casing 14 within a 9.625 inch diameter outer casing 16. It will be appreciated by those skilled in the art, however, that other diameter casings 14, 16 may be centralized using the tools and methods disclosed herein.

Referring again to FIGS. 3 and 4, the piston 30A may be forced in the direction A in response to a force provided via the work string 27, as generally described above. In one embodiment, as discussed above, the force may be a hydraulic force. In other embodiments, however, the force may include a mechanical force, a pneumatic force, combinations thereof, or the like. Once the expansion tool 10 is run to a first expansion depth within the wellbore, pressure is increased on the work string to a predetermined pressure to begin and complete the expansion process. Generally, the expansion process is completed when pressure is increased to a point where the inner casing 14 has been deformed to engage or otherwise be centered within the outer casing 16 and the expansion tool 10 does not move when an upward force exceeding the weight of the work string 27 is exerted on the work string 27 from the surface. In some embodiments, once concentric clearance 12 is obtained, pressure may be held at a predetermined level for a predetermined amount of time. While maintaining this pressure, the pick-up (PU) weight on the work string 27 may be brought to a predetermined weight over the initial pick-up weight. This may also confirm that the expansion is complete and a concentric stand-off has been effectively created.

Where desirable, the centralization of other intervals along the annulus 15 may be achieved by resetting the expansion tool 10 and reusing the expansion tool 10, as generally described above. For example, the expansion tool 10 may be disengaged from the inner casing 14 by zeroing the weight indicator (i.e., slacked off to a neutral point) and pressure may then be allowed to bleed out of the work string 27. Afterwards, pressure may be applied within the annulus 15 in order to reset the expansion tool 10. The expansion tool 10 may then be brought to another depth to repeat the expansion process.

In some embodiments, multiple expansion tools 10 may be used in a single wellbore. This may be particularly useful in the preparing of a subsequent cementing operation. The overall effect is that the whole length of inner casing 14 is centered relative the outer casing 16. Ideally, the annulus 15 at the kick-off point has a stand-off percentage of 100%. However, commencement of a new wellbore may equally be possible without achieving 100% stand-off. For example, approximately 70% or more stand-off may be needed to properly execute a competent cementing job in the annulus 15.

Figure 5:
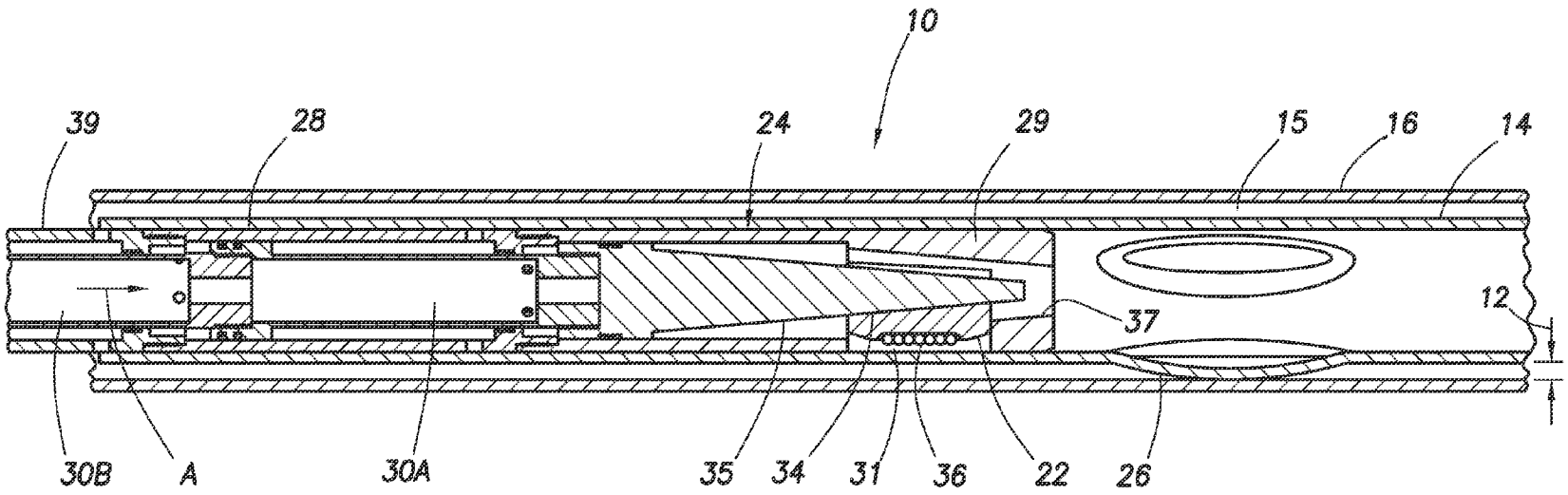
FIG. 5 shows a schematic drawing of the hydraulic expansion tool configured with multiple force multipliers, in accordance with certain aspects of the present disclosure.
Figure 6:
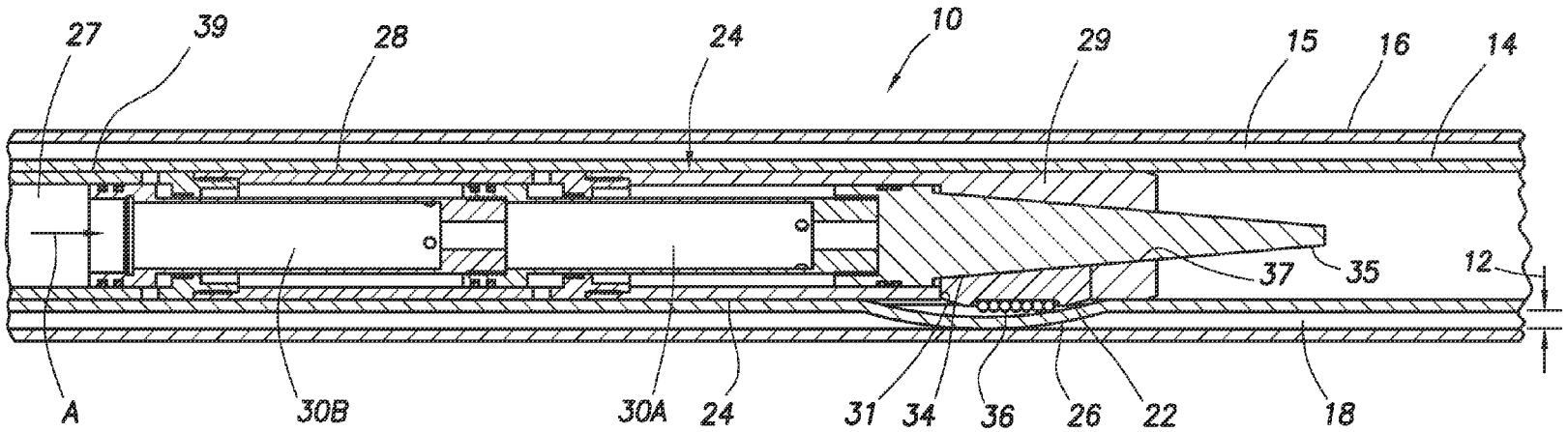
FIG. 6 shows a schematic drawing of the hydraulic expansion tool configured with multiple force multipliers, in accordance with certain aspects of the present disclosure.

Referring now to FIGS. 5 and 6, illustrated is another embodiment of the exemplary expansion tool 10. The body 24 of the expansion tool 10 may include a second force multiplier case 39 coupled or otherwise attached to the first force multiplier case 28. A force multiplying piston 30B may be substantially arranged within the second force multiplier case 39. The piston 30B may be configured to translate axially within the case 38 in response to a force (e.g., hydraulic, pneumatic, mechanical, etc.) applied thereto in the axial direction A. In other words, the piston 30B may be actuated by the input of an independent force or stimulus, such as through hydraulic pressure applied through the work string 27. In other embodiments, however, the piston 30B may be characterized as a hydraulic actuator and able to be actuated independently in order to move in the axial direction A. In yet other embodiments, the piston 30B may be characterized as an electric actuator, mechanical actuator, pneumatic actuator, combinations thereof, or the like, in order to move in the axial direction A.

In operation, the force multiplying piston 30B may be considered a force multiplier, also sometimes referred to as a mechanical advantage device. Accordingly, in at least one embodiment, the second force multiplying piston 30B may be configured to apply a multiplying force on the piston 30A and thereby generate an increased resulting force as applied on the ram 34 in the direction A. When desirable, additional force multiplying pistons or devices (not shown) may be added and coupled to the expansion tool 10 in order to increase the axial force applied to the ram 34. Each force multiplier (i.e., the first and second force multiplying pistons 30A, 30B) may be configured to multiply the forces of an initial mechanism by providing mechanical advantage. In other embodiments, the pistons 30A, 30B may cooperatively work in order to multiply the collective forces of each device as applied to the ram 34.

Similar to the one force multiplier expansion tool 10 discussed above with reference to FIGS. 3 and 4, the ram 34 may be configured to translate forces along the longitudinal axis of the first casing 14 into a radial force applied at each lug assembly 22. For instance, the force multiplying piston 30B may be configured to act on and multiply the axial force provided by the piston 30A, which transfers the resulting force to the ram 34 in the direction A. As the ram 34 moves in the direction A, the lug assemblies 22 extend radially and cooperatively act to deform the inner casing 14 and form a corresponding number of lobes 26 (FIG. 6). The resulting concentric clearance 12 or centering of the inner casing 14 relative to the outer casing 16 isolates the inner casing 14 from the pressure and stress experienced by the outer casing 16, which makes the wellbore safer, more reliable, confident, and competent. Generally speaking, pressure on the outer casing 16 will be the result of fluid channeling up through the cemented portion of the inner casing 14 and into the uncemented annulus 15 between the two casings 14, 16 above the cement top of the inner casing 14. Again, establishing a concentric annulus 15 does not isolate the two casing strings 14, 15 in and of itself. By establishing a concentric or near concentric annulus 15, the benefit is that it allows placement of a cement slurry to fill the annulus 15 with reduced risk of cement channeling along the low side of the inner casing 14.

While FIGS. 3-6 show an expansion tool 10 having minimal or zero clearance with the inner casing 14, this is not intended to be limiting to the disclosure. Other embodiments, for example, may provide at least some clearance between the expansion tool 10 and the inner casing 14.

Figure 7B:
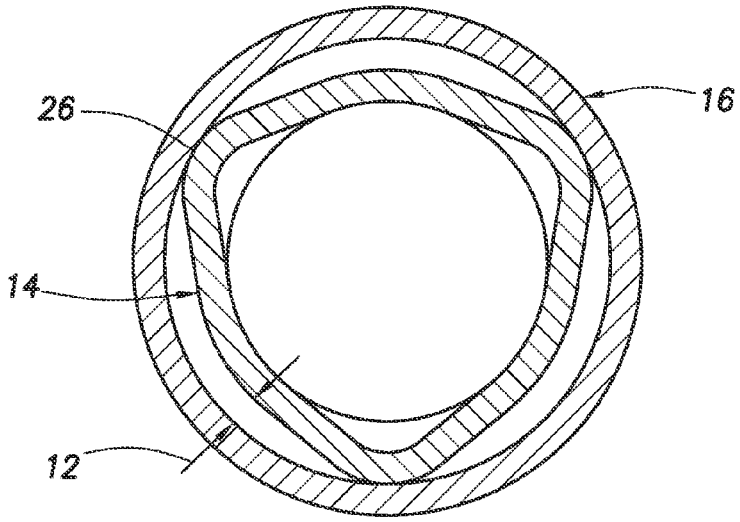

FIGS. 7A-7B show cross-sectional top views of the casings 14, 16 while the expansion tool 10 is engaged with the casings (FIG. 7A) and subsequently released (FIG. 7B). As generally described above, the expansion tool 10 includes lug assemblies 22 and a ram 34 that work together to deform the inner casing 14 and create one or more lobes 26 which provide concentric clearance 12. As illustrated, the inner casing 14 may be deformed in multiple distinct locations about its inner surface so as to define the concentric clearance 12 between the inner casing 14 and the outer casing 16.

Various methods of centralizing the inner casing 14 within the outer casing 16 are provided herein. One method includes introducing an expansion tool into the inner casing. The expansion tool may have an elongate body having a first force multiplier case coupled to an expansion tool case. A piston arranged within the first force multiplier case may then be actuated to move the piston axially in a first direction within the first force multiplier case. Actuating the piston may include actuating one of a hydraulic actuator, a mechanical actuator, an electric actuator, and a pneumatic actuator, or combinations thereof.

The method further includes engaging a ram arranged within the expansion tool case with the piston, and radially expanding one or more lug assemblies arranged within the expansion tool case with the ram as the ram axially translates in the first direction. Radially expanding the one or more lug assemblies may include engaging the one or more lug assemblies with a tapered surface defined on the ram. The method may also include plastically deforming the inner casing with the one or more lug assemblies. The one or more lug assemblies may be configured to generate a corresponding one or more lobes in the inner casing that are configured to engage an inner surface of the outer casing. Moreover, plastically deforming the inner casing with the one or more lug assemblies may also include engaging an inner surface of the inner casing with one or more lug components arranged on an outer surface of the one or more lug assemblies. Plastically deforming the inner casing may even further include engaging the inner surface of the outer casing with the one or more lug assemblies in order to center the inner casing within the outer casing.

The method may also include engaging the tapered surface of the ram with a corresponding tapered surface defined on the expansion tool case, and thereby maintaining the ram concentrically-disposed within the expansion tool case as the ram translates axially. The method may even further include actuating a force multiplying piston arranged within a second force multiplier case coupled to the elongate body. The force multiplying piston may be configured to axially translate in the first direction within the second force multiplier case. A multiplying force may then be applied on the piston with the force multiplying piston such that an increased force is applied on the ram.

In some embodiments, another method for centralizing the inner casing 14 within the outer casing 16 is provided. The method may include introducing an expansion tool into the inner casing. The expansion tool may have an elongate body configured to be coupled to a work string and run into a wellbore. A piston arranged within the elongate body may then be actuated to thereby moving the piston axially in a first direction within the elongate body. Actuating the piston may include actuating one of a hydraulic actuator, a mechanical actuator, an electric actuator, and a pneumatic actuator. The method may also include engaging a ram arranged within the elongate body with the piston and thereby forcing the ram to axially translate in the first direction. The ram may define a tapered surface in contact with one or more lug assemblies arranged within a corresponding one or more cavities defined in the elongate body.

The method may further include radially expanding the one or more lug assemblies with the ram as the ram axially translates in the first direction. Radially expanding the one or more lug assemblies may include radially translating each lug assembly within the corresponding one or more cavities. The one or more cavities may further sever to maintain the one or more lug assemblies in an axial position. The method may yet further include plastically deforming the inner casing with the one or more lug assemblies. The one or more lug assemblies may be configured to generate a corresponding one or more lobes lugs in the inner casing configured to engage an inner surface of the outer casing. Plastically deforming the inner casing with the one or more lug assemblies may also include engaging an inner surface of the inner casing with one or more lug components arranged on an outer surface of the one or more lug assemblies.

The method may also include engaging the tapered surface with a corresponding tapered surface defined on the elongate body, and thereby maintaining the ram concentrically-disposed within the elongate body as the ram translates axially. In some embodiments, the method includes actuating a force multiplying piston arranged within the elongate body. The force multiplying piston may be configured to axially translate in the first direction within the second force multiplier case. A multiplying force may then be applied on the piston with the force multiplying piston such that an increased force is applied on the ram. The method may also include releasing the expansion tool after centralizing the inner casing, moving the expansion tool to another location within the inner casing, and radially-expanding the one or more lug assemblies a second time with the ram. The inner casing may then be plastically deformed with the one or more lug assemblies at the other location within the inner casing.

In some embodiments, other methods of the present invention generally include providing a wellbore; an inner casing and an outer casing that defines a casing-casing annulus comprising: an inner casing, an outer casing, and a non-cemented interval, wherein the casing-casing annulus has a first stand-off percentage; running an expansion tool capable of centering the inner casing relative to the outer casing; centering the inner casing relative to the outer casing thereby increasing the clearance of the casing-casing annulus to a second stand-off percentage; perforating the inner casing to create a path between the inner casing and the casing-casing annulus; placing a settable fluid in the non-cemented interval thereby at least partially covering the non-cemented interval; cutting a window through the inner casing and outer casing in a newly cemented interval so as to provide wellbore access to the surface outside the outer casing. The newly cemented interval is in the proximity of the radially expanded lobes that were expanded to provide for optimal cementing. Optionally, the methods may further comprise: drilling a new wellbore from the window.

In some embodiments, the new wellbore is deviated. In some embodiments, the new wellbore allows access to a new reservoir. In some embodiments, the new wellbore allows drilling around a lost tool that is blocking an existing wellbore.

The settable fluid may be any fluid that hardens after being placed. In some embodiments, the settable fluid is selected from the group consisting of: cement, resin, composite, and combinations thereof.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method for centralizing an inner casing within an outer casing, comprising:

introducing an expansion tool into the inner casing, the expansion tool having an elongate body having a first force multiplier case coupled to an expansion tool case;

actuating a piston arranged within the first force multiplier case and thereby moving the piston axially in a first direction within the first force multiplier case;

engaging a ram arranged within the expansion tool case with the piston, the ram defining a tapered surface engageable with a correspondingly tapered surface defined on the expansion tool case;

radially expanding one or more lug assemblies arranged within the expansion tool case with the ram as the ram axially translates in the first direction;

centering the ram within the first force multiplier case while the ram axially translates in the first direction by engaging the tapered surface of the ram on the correspondingly tapered surface of the expansion tool case; and plastically deforming the inner casing with the one or more lug assemblies, the one or more lug assemblies generating a corresponding one or more lobes in the inner casing configured to engage an inner surface of the outer casing.

2. The method of claim 1, wherein plastically deforming the inner casing with the one or more lug assemblies further comprises engaging an inner surface of the inner casing with one or more lug components arranged on an outer surface of the one or more lug assemblies.

3. The method of claim 1, wherein radially expanding the one or more lug assemblies further comprises engaging the one or more lug assemblies with the tapered surface defined on the ram.

4. The method of claim 1 wherein actuating the piston further comprises actuating one of a hydraulic actuator, a mechanical actuator, an electric actuator, and a pneumatic actuator.

5. The method of claim 1, further comprising:

actuating a force multiplying piston arranged within a second force multiplier case coupled to the elongate body, the force multiplying piston being configured to axially translate in the first direction within the second force multiplier case; and applying a multiplying force on the piston with the force multiplying piston such that an increased force is applied on the ram.

6. The method of claim 1, wherein plastically deforming the inner casing further comprises engaging the one or more lugs against an inner surface of the inner casing to generate the one or more lobes in the inner casing, the one or more lobes subsequently engaging an inner surface of the outer casing and thereby centering the inner casing within the outer casing.

7. A method for centralizing an inner casing within an outer casing, comprising:

introducing an expansion tool into the inner casing, the expansion tool having an elongate body configured to be coupled to a work string and run into a wellbore;

actuating a piston arranged within the elongate body and thereby moving the piston axially in a first direction within the elongate body;

engaging a ram arranged within the elongate body with the piston and thereby forcing the ram to axially translate in the first direction, the ram defining a tapered surface in contact with one or more lug assemblies arranged within a corresponding one or more cavities defined in the elongate body, the tapered surface further being engageable with a correspondingly tapered surface defined on the elongate body;

radially expanding the one or more lug assemblies with the ram as the ram axially translates in the first direction;

centering the ram within the elongate body while the ram axially translates in the first direction by engaging the tapered surface of the ram on the correspondingly tapered surface of the elongate body; and plastically deforming the inner casing with the one or more lug assemblies, the one or more lug assemblies generating a corresponding one or more lobes in the inner casing configured to engage an inner surface of the outer casing.

8. The method of claim 7, wherein plastically deforming the inner casing with the one or more lug assemblies further comprises engaging an inner surface of the inner casing with one or more lug components arranged on an outer surface of the one or more lug assemblies.

9. The method of claim 7, wherein actuating the piston further comprises actuating one of a hydraulic actuator, a mechanical actuator, an electric actuator, and a pneumatic actuator.

10. The method of claim 7, further comprising:

actuating a force multiplying piston arranged within the elongate body, the force multiplying piston being configured to axially translate in the first direction within the elongate body; and applying a multiplying force on the piston with the force multiplying piston such that an increased force is applied on the ram.

11. The method of claim 7, wherein radially expanding the one or more lug assemblies further comprises radially translating each lug assembly within the corresponding one or more cavities.

12. The method of claim 11, further comprising maintaining the one or more lug assemblies in an axial position with the corresponding one or more cavities.

13. The method of claim 7 further comprising:

releasing the expansion tool after centralizing the inner casing;

moving the expansion tool to another location within the inner casing;

radially expanding the one or more lug assemblies a second time with the ram; and plastically deforming the inner casing with the one or more lug assemblies at the other location within the inner casing, the one or more lug assemblies generating a corresponding one or more lobes in the inner casing configured to engage the inner surface of the outer casing.

14. The method of claim 7, wherein plastically deforming the inner casing with the one or more lug assemblies comprises moving the inner casing from a first stand-off distance from the outer casing to a second stand-off distance from the outer casing, wherein the first stand-off distance exhibits a first stand-off percentage and the second stand-off distance exhibits a second stand-off percentage greater than the first stand-off percentage.

* * * * *